US009412236B2

(12) United States Patent
Earley et al.

(10) Patent No.: US 9,412,236 B2
(45) Date of Patent: Aug. 9, 2016

(54) PLAYER INITIATED MULTI-PLAYER GAMES

(71) Applicant: WMS Gaming, Inc., Waukegan, IL (US)

(72) Inventors: Edward Q. Earley, Chicago, IL (US); Damon E. Gura, Chicago, IL (US); Joel R. Jaffe, Glenview, IL (US); Larry J. Pacey, Northbrook, IL (US); Craig J. Sylla, Round Lake, IL (US); Jamie W. Vann, Chicago, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 0 days.

(21) Appl. No.: 13/789,315

(22) Filed: Mar. 7, 2013

(65) Prior Publication Data

US 2014/0038709 A1 Feb. 6, 2014

Related U.S. Application Data

(60) Provisional application No. 61/677,865, filed on Jul. 31, 2012.

(51) Int. Cl.
*G07F 17/32* (2006.01)

(52) U.S. Cl.
CPC ..... *G07F 17/3272* (2013.01); *G07F 17/323* (2013.01)

(58) Field of Classification Search
USPC ..... 463/30, 31, 32, 40
See application file for complete search history.

(56) References Cited

U.S. PATENT DOCUMENTS

| | | | |
|---|---|---|---|
| 5,659,790 | A | 8/1997 | Kim et al. |
| 5,971,271 | A | 10/1999 | Wynn et al. |
| 6,139,433 | A | 10/2000 | Miyamoto et al. |
| 6,404,446 | B1 | 6/2002 | Bates et al. |
| 2004/0162144 | A1 | 8/2004 | Loose et al. |

(Continued)

FOREIGN PATENT DOCUMENTS

| | | |
|---|---|---|
| WO | WO-2007098035 | 8/2007 |
| WO | WO-2009097538 | 8/2009 |

OTHER PUBLICATIONS

"About TheBrain Visual Knowledge Networks for People", *TheBrain Visual Information Management* www.thebrain.com (Jan. 29, 2008). 2007 , 1 page.

*Primary Examiner* — Paul A D'Agostino
*Assistant Examiner* — Brandon Gray
(74) *Attorney, Agent, or Firm* — DeLizio Law, PLLC

(57) ABSTRACT

Some embodiments include a computer-implemented method for enabling a player to configure and initiate multi-player wagering games. The computer-implemented method can include presenting, on a display device of a wagering game machine, a graphical user interface including social contact icons representing social contacts associated with the player, and a multiplayer wagering game icon associated with a multiplayer wagering game. The method can also include detecting input indicating selection of the multiplayer wagering game icon and the social contact icons. The method can also include transmitting, to the social contacts via a network, invitations to participate in the multiplayer wagering game. The method can also include detecting acceptance of the invitations from at least one of the social contacts, and conducting the multiplayer wagering game involving the player and the at least one of the social contacts.

15 Claims, 12 Drawing Sheets

(56) References Cited

U.S. PATENT DOCUMENTS

| | | | | |
|---|---|---|---|---|
| 2005/0261062 | A1 | 11/2005 | Lewin et al. | |
| 2006/0252530 | A1 | 11/2006 | Oberberger et al. | |
| 2008/0020845 | A1 | 1/2008 | Low et al. | |
| 2010/0004055 | A1* | 1/2010 | Gormley et al. | 463/25 |
| 2010/0160035 | A1* | 6/2010 | Herrmann | 463/25 |
| 2010/0323785 | A1* | 12/2010 | Motyl et al. | 463/25 |
| 2012/0028718 | A1* | 2/2012 | Barclay et al. | 463/42 |
| 2013/0027432 | A1* | 1/2013 | Chen et al. | 345/649 |

* cited by examiner

PLAYER INITIATED MULTI-PLAYER GAMES

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

FIELD

Embodiments of the inventive subject matter relate generally to wagering game systems, and more particularly to configuring multiplayer games in land-based and online wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the invention are illustrated in the Figures of the accompanying drawings in which.

DESCRIPTION OF THE EMBODIMENTS

Figure 1:
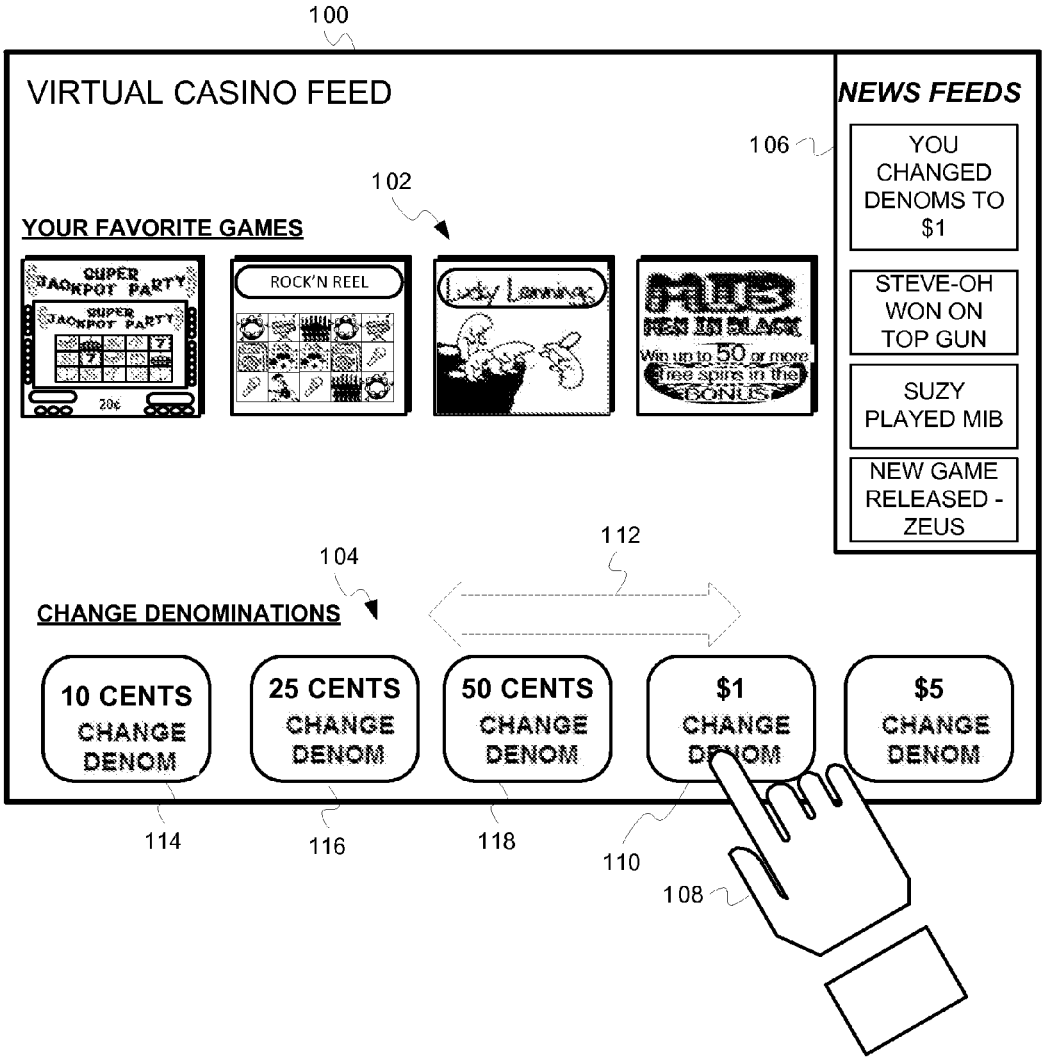
FIG. 1 is a diagrammatic representation of a graphical user interface for selecting wagering games, and configuring wagering game options.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Introduction

This section provides an introduction to some embodiments of the invention.

Traditionally, wagering game machines were available only at bricks-and-mortar casinos. However, with the advent of Internet technologies, some wagering game providers began offering online websites at which players could play wagering games. In both gaming venues (i.e., bricks-and-mortar and online), players typically have very little control over gaming options. Some embodiments of the inventive subject matter enable players to configure numerous options in both bricks-and-mortar wagering game machines and online games. In some embodiments, bricks-and-mortar casino operators give players control over wagering game machine settings, such as denominations, maximum bets, game type (e.g., five line electronic slots, 12 line electronic slots, etc.), thematic presentation (e.g., sports theme, movie theme, etc.), audio settings, video settings, etc. Therefore, some embodiments enable players to configure (and reconfigure) wagering game machines to their liking. As a result, players need not move about casinos in search of particular machine configurations. For example, instead of moving to a different machine, a player can significantly increase betting by changing his/her machine's denomination configuration. As another example, instead of moving to different machine, the player can change game types, such as changing from video slots to video poker.

Like machine configuration, players have had little control over multiplayer games. Typically, a player's game becomes part of a multiplayer bonus round after hitting a particular slot reel combination. After hitting the slot reel combination, the player's game becomes part of a multiplayer bonus round with other players who hit similar slot reel combinations. Some embodiments give players control over who participates in multiplayer games. Some embodiments allow players to initiate multiplayer games (e.g., without first having a particular reel combination), and invite particular players to play the multiplayer games. Some embodiments allow players to select multiplayer game participants from their social network contact lists (e.g., Facebook friends list, casino-based social network friends list, etc.).

For online gaming, some embodiments offer online casinos that enable players to configure various gaming options and multiplayer games, as described above. Additionally, some embodiments allow online players to configure and operate virtual casinos. The virtual casinos include virtual wagering game machines on which players can play online wagering games. As players build more attractive virtual casinos, their virtual casinos may attract more player traffic, and they may receive various awards for building popular virtual casinos.

The following sections describe many other features and embodiments.

Configuration Interfaces

This section describes graphical user interfaces that enable players to configure wagering game machines, and online wagering games. Some of the interfaces allow players to configure and initiate multiplayer wagering games.

FIG. 1 is a diagrammatic representation of a graphical user interface for selecting wagering games, and configuring wagering game options. As shown, a graphical user interface (GUI) 100 presents a list of a player's favorite games 102, a list of selectable gaming options, and newsfeeds 106. The GUI 100 can appear on a touch screen display or other suitable display device. Using the graphical user interface, the player 108 can initiate a wagering game by selecting an icon from the list of the player's favorite games. Additionally, the player 108 can view the newsfeeds. In some instances, the newsfeeds are relevant to the player 108, as they describe activities of the player's social contacts (e.g. from Facebook, from a casino-based social network, etc.). For example, the newsfeeds 106 indicate that the player's friend "Steve-Oh" recently won an award playing a "TopGun" slots game.

In the GUI 100, the selectable gaming options are denominations for wagering games. Denominations represent an amount of money for each gaming credit associated with a wagering game. If the denominations are $0.10, when the player bets one gaming credit, the player is betting $0.10. The GUI 100 enables the player 108 to select a desired denomination. For example, FIG. 1 shows the player 108 selecting a "$1 denomination" icon 110. As a result of the selection, the player will bet at least $1 on each wagering game.

Although FIG. 1 shows only denominations, the GUI 100 can allow players to configure any suitable gaming options, such as maximum bets, theme, audio settings, video settings, etc. As another example, players may adjust a machine's volatility, which adjusts frequency and amount of jackpots. High volatility may be characterized by infrequent jackpots that are relatively large. Low volatility may be characterized by more frequent jackpots that are relatively small.

As shown in FIG. 1, the GUI 100 shows two rows of icons—the player's favorite game icons 102 and denomination icons 104. The player 108 can move through the denomination icons 104 by dragging them horizontally across the interface (see arrow 112). For the row of denomination icons 104, the icons can shift left-to-right or right-to-left, depending player input. As the icons shift, some icons move out of the GUI 100, while new game icons enter the GUI. For example, if the denomination icons shift left, the icon 114 will disappear from the GUI 100 and the icon 116 will move into the position formerly occupied by icon 316. Additionally, the icon 118 will move into the position formerly occupied by the icon 116, and so on until all the icons shift. At some point, the denomination icons 104 may "wrap-around" and appear again in the GUI 104. The same mechanics apply to the favorite game icons 102.

Although the icons 102 and 104 span the GUI horizontally (in FIG. 1), they could also appear vertically. If the icons appear vertically, the icons could move vertically according to the mechanics described above.

As part of a process for initiating wagering games, some embodiments provide a GUI through which players can select wagering games, such as: games their friends have played, their own favorite games, multiplayer games to play with their friends. The discussion of FIG. 2 describes this in more detail.

Figure 2:
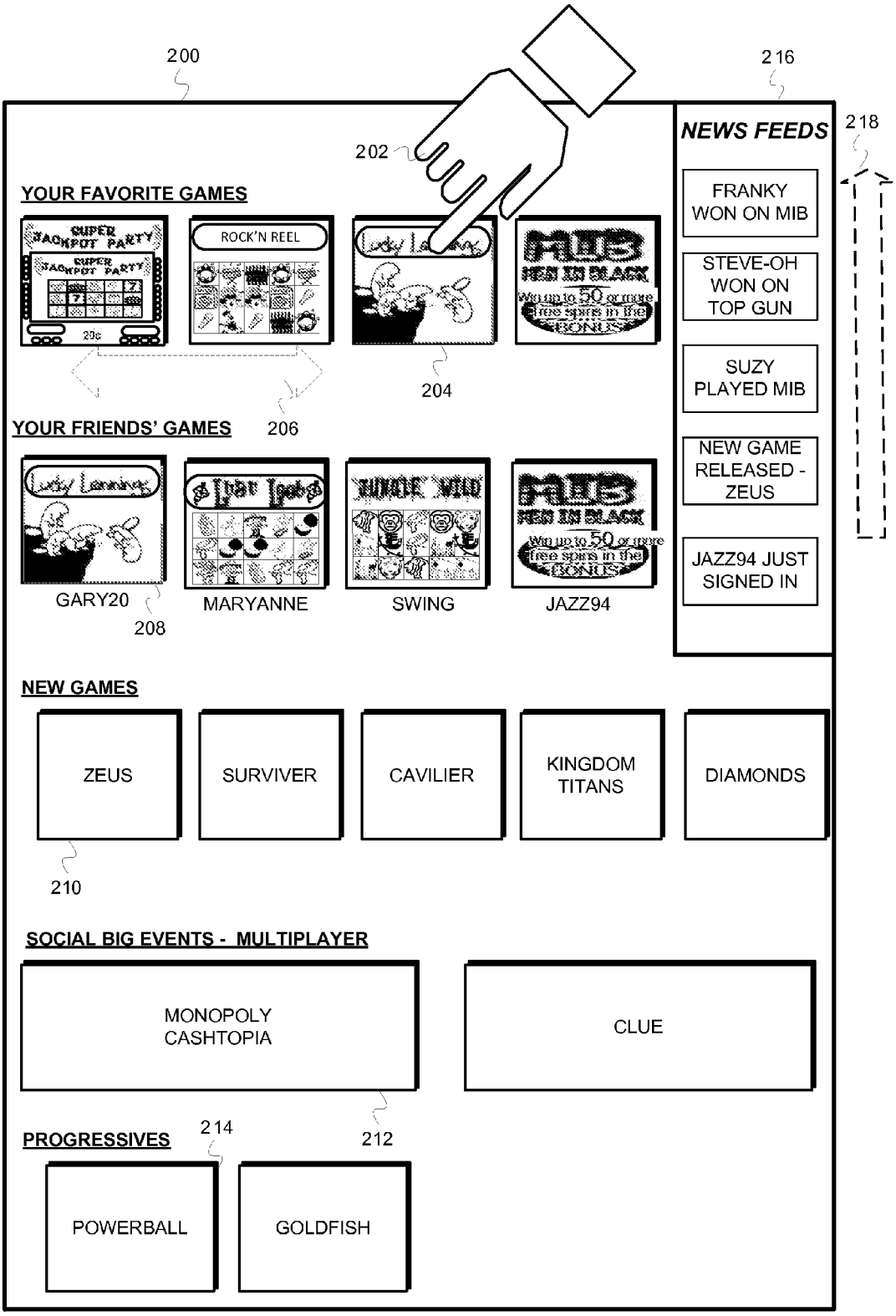
FIG. 2 is a diagrammatic representation of a graphical user interface for facilitating wagering game selection, according to some embodiments of the inventive subject matter.

FIG. 2 is a diagrammatic representation of a graphical user interface for facilitating wagering game selection, according to some embodiments of the inventive subject matter. In FIG. 2, a GUI 200 presents several rows of player-selectable game icons including: icons representing the players favorite games (favorite game icons 204), icons representing games of the player's friends (friends' games icons 208), icons representing newly released games (new games icons 210), icons representing multiplayer games (multiplayer game icons 212), and icons representing progressive games (progressive game icons 214).

The player 202 can initiate single-player wagering games by selecting an icon from the favorite game icons 204, friends' games icons 208, new games icons 210, and progressive game icons 214. The player 202 can slide the icons left-to-right or right-to-left (see arrow 206), as described above. As the player 202 slides the icons, new icons may appear with more game choices (see discussion above).

The player 202 can initiate multiplayer games by dragging one or more of the friends' games icons onto any one of the multiplayer game icons 212. The discussion of FIGS. 3 and 4 describe selecting multiplayer games in more detail (see below).

The GUI 200 also includes a newsfeed window 216. The newsfeed window 216 presents information about events relevant to the player. For example, news items may indicate that the player's friend recently won a jackpot on a particular wagering game. Alternatively, the news items may indicate that the player's friends have played certain games, signed into the wagering game system (online or in a breaks-and-mortar casino), made particular configuration choices, etc. The newsfeed window 216 can publish any other events the player may find interesting. In the embodiment shown in FIG. 2, new news items appear at the bottom of the newsfeed window 216, and move to the top as additional news items appear (see arrow 218). A news item occupying the top position will disappear from the newsfeed window 216 upon presentation of the next new news item.

This discussion will continue with a description of how the GUI enables players to configure and initiate multiplayer games.

Figure 3:
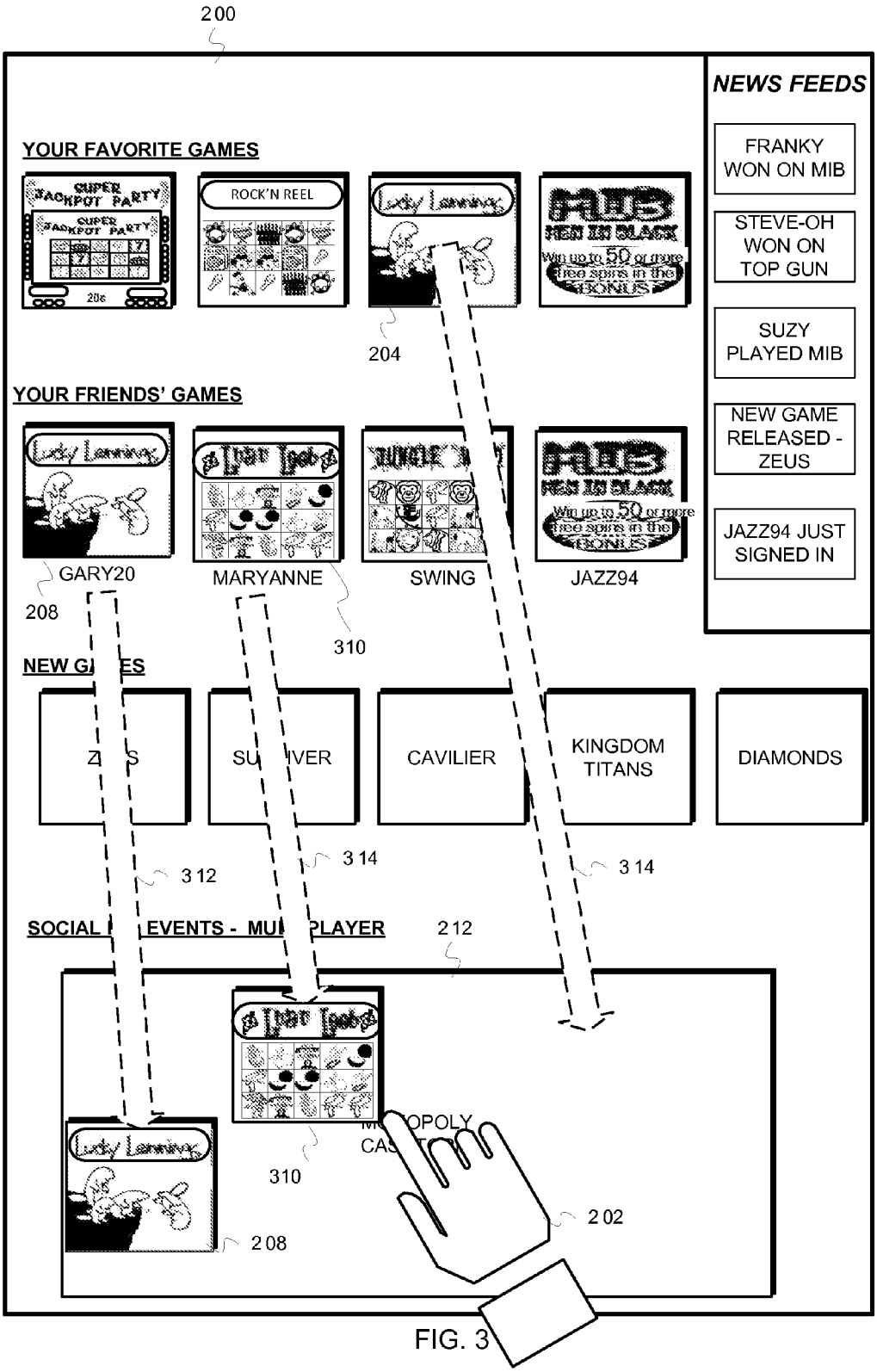
FIG. 3 is a diagrammatic representation of GUI operations for configuring multiplayer wagering games.

FIG. 3 is a diagrammatic representation of GUI operations for configuring multiplayer wagering games. FIG. 3 shows the GUI 200 after the player 202 has selected a multiplayer game icon 212 for a multiplayer Monopoly Cashtopia game. After the selection, the multiplayer game icon 212 expands to fill a large portion of the GUI 200, overlaying the other multiplayer game icons and progressive game icons 214 (which were shown in FIG. 2). After the multiplayer game icon 212 expands, the player can invite friends to play the selected multiplayer game by dragging-and-dropping icons onto the multiplayer game icon 212. For example, as shown, the player 202 drags-and-drops an icon 310 onto the multiplayer game icon 212 (see arrow 314), where the icon 310 is associated with the player's friend "MaryAnne" FIG. 3 shows a similar drag-and-drop operation for the player's friend "Gary20" (see arrow 312). After these drag-and-drop operations complete, the wagering game system invites the selected friends (i.e., MaryAnne and Gary20) to participate in the multiplayer Monopoly Cashtopia game. The discussion of FIG. 8 (below) provides additional details about how embodiments of the wagering game system configured and conduct the multiplayer wagering game.

Figure 4:
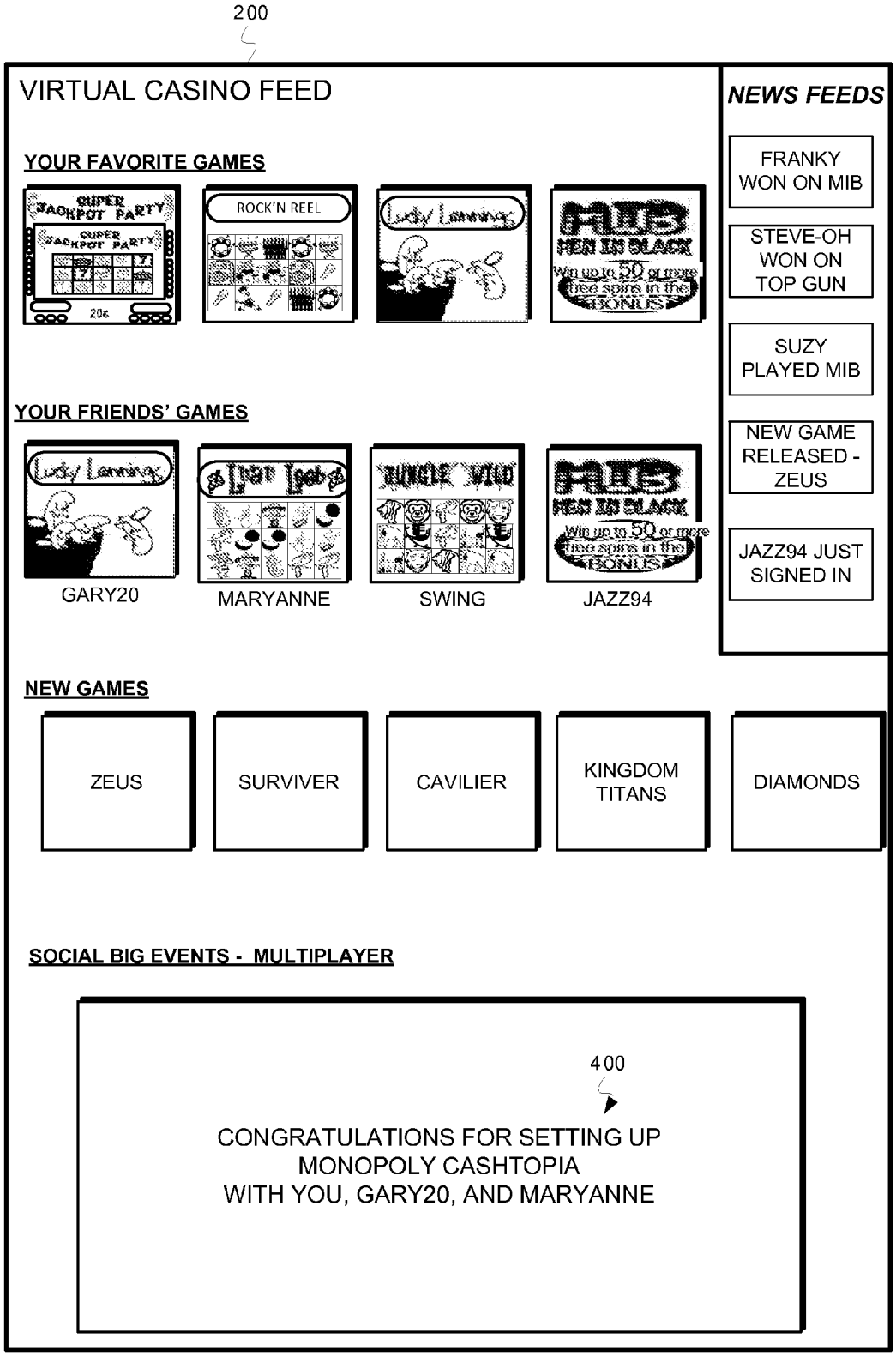
FIG. 4 is a diagrammatic representation of a GUI showing confirmation that player has successfully configured a multiplayer wagering game.

In some embodiments, the player 202 is not automatically included in a selected multiplayer game. In such embodiments, the player can select himself/herself by dragging-and-dropping a favorite games icon 204 onto a selected multiplayer game icon 212. In other embodiments, dragging-and-dropping a favorite games icon 204 onto a multiplayer game icon constitutes both selection of the multiplayer game icon and selection of the player himself/herself to participate in the multiplayer game. That is, some embodiments of the GUI 200 do not require the player 202 initially select a multiplayer game icon before dragging-and-dropping a favorite games icon onto the multiplayer game icon. FIG. 4 shows how the GUI confirms configuration of the multiplayer game.

FIG. 4 is a diagrammatic representation of a GUI showing confirmation that player has successfully configured a multiplayer wagering game. FIG. 4 shows the GUI 200 after completion of the drag-and-drop operations shown in FIG. 3. In FIG. 4, the wagering game system presents a confirmation message 400 indicating the selected multiplayer game, and the players that will be invited to play it.

This discussion will continue with a description of the wagering game system components that provide the functionality described herein.

Operating Environment

This section describes an example operating environment and presents structural aspects of some embodiments. This section includes discussion about wagering game networks and wagering game machine architectures.

Wagering Game Networks

Figure 5:
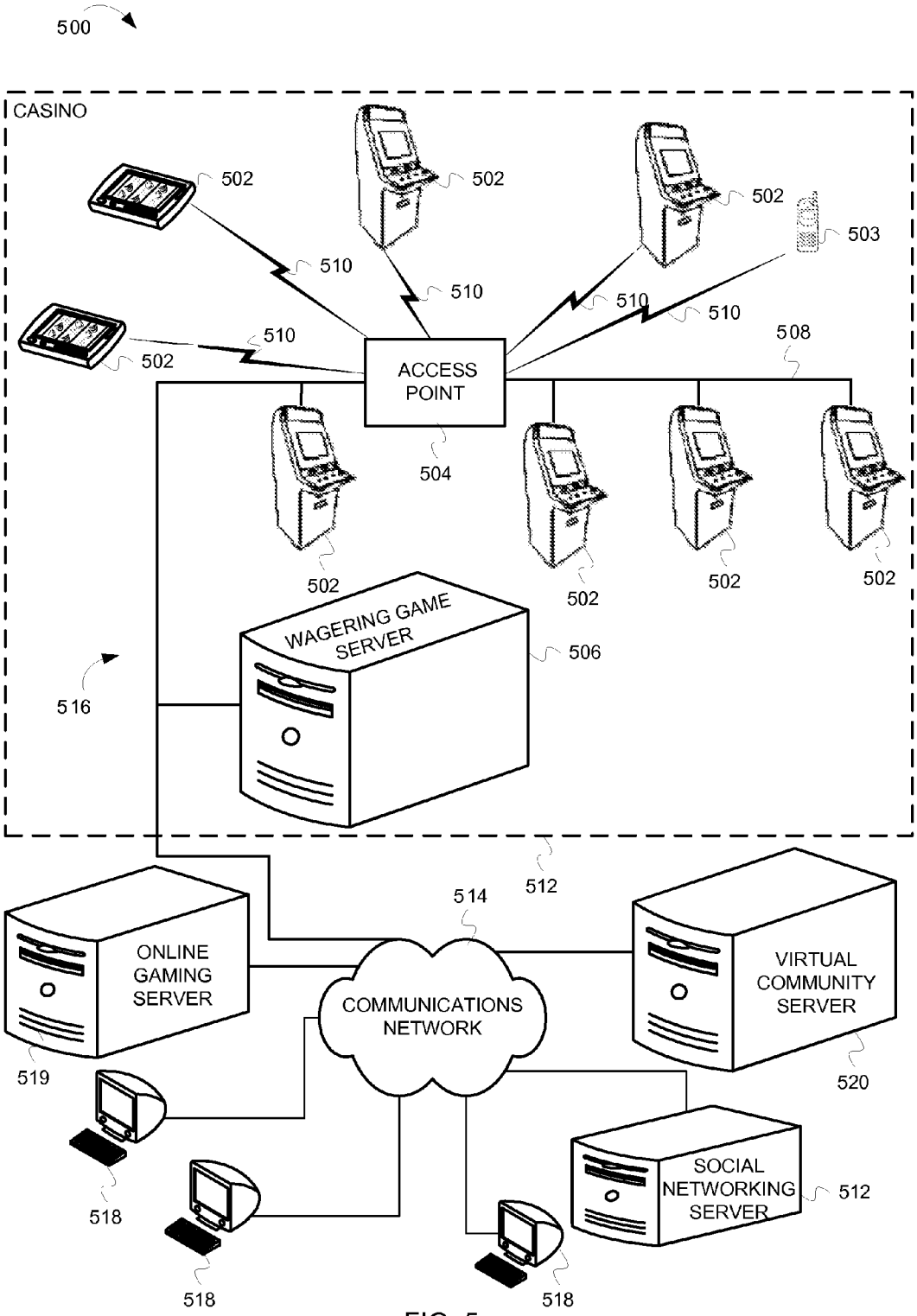
FIG. 5 is a block diagram illustrating a wagering game network 500, according to example embodiments of the invention.

FIG. 5 is a block diagram illustrating a wagering game network 500, according to example embodiments of the invention. As shown in FIG. 5, the wagering game network 500 includes a plurality of devices connected to a communications network 514. The (bricks-and-mortar) casino 512 includes a local area network 516, which includes an access point 504, a wagering game server 506, and wagering game machines 502. The access point 504 provides wireless communication links 510 and wired communication links 508. The wired and wireless communication links can employ any suitable connection technology, such as Bluetooth, 802.11, Ethernet, public switched telephone networks, SONET, etc. In some embodiments, the wagering game server 506 can host wagering games and distribute content (e.g., wagering game results) to devices located in the casino 512 or at other locations on the communications network 514.

The communications network 514 is also connected to an online gaming server 519, virtual community server 520, and social networking server 512. In some embodiments, the servers 506, 519, 520, and 512 can exchange information to facilitate the functionality described herein. For example, the wagering game server 506 can access information on the social networking server 512 to determine a player's friends.

The social networking server 512 may be operated by an entity separate from the entity/entities who operate the other servers. For example, the servers 506, 519, 520, and 512 may request data from Facebook, Twitter, 4Square, or social networking websites. As a result, the social networking server 512 may provide an application programming interface through which the other servers accessed social networking information. Likewise, any of the servers may provide a similar application programming interface for sharing information.

The virtual gaming community server 520 can include a website and other facilities through which community members interact with each other. In some embodiments, the virtual community server 520 hosts a wagering-game-related virtual community in which gamers can interact. Virtual community members can use the computing devices 518 to access the virtual community server's web site and other facilities. The wagering game machines 502 can exchange information with the virtual community server 520 and workstations 518. As a result, community members who are online (i.e., who are using the workstations 518) can interact with community members who are in the casino 512. For example, online members can monitor wagering games and other activities occurring on the wagering game machines 502 in the casino 512. In some instances, community members at the devices 518 can participate in wagering games occurring in the casino 104, exchange messages with community members who are at the wagering game machines 502, and much more. In some embodiments, the virtual community server can facilitate one or more of the following:

- Create Social Networks—Members can become "social contacts" or "friends" with other members of the virtual community. When creating social networks, members can create electronic associations that inform network members when selected members are: 1) online, 2) performing activities, 3) reaching milestones, 4) etc.
- Establish a Reputation—Community members can establish reputations based on feedback from other community members, based on accomplishments in the community, based on who is in their social network, etc.
- Provide Content—Community members can provide content by uploading media, designing wagering games, maintaining blogs, etc.
- Filter Content—Community members can filter content by rating content, commenting on content, or otherwise distinguishing content.
- Interact with Other Members—Community members can interact via newsgroups, e-mail, discussion boards, instant messaging, etc.
- Participate in Community Activities—Community members can participate in community activities, such as multi-player games, interactive meetings, discussion groups, real-life meetings, etc.

Figure 8:
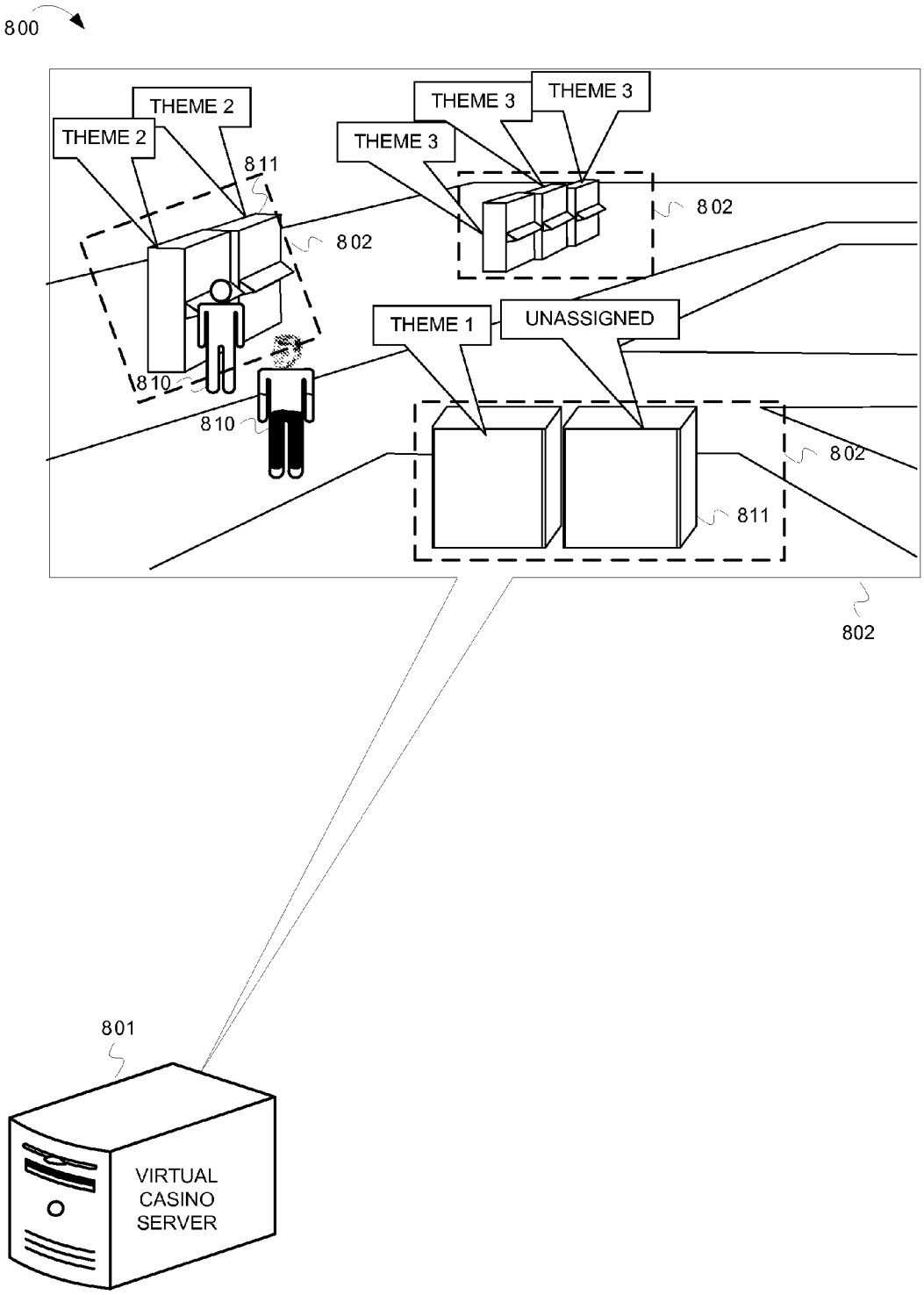
FIG. 8 is a diagrammatic representation of a virtual casino, according to some embodiments of the inventive subject matter.
Figure 9:
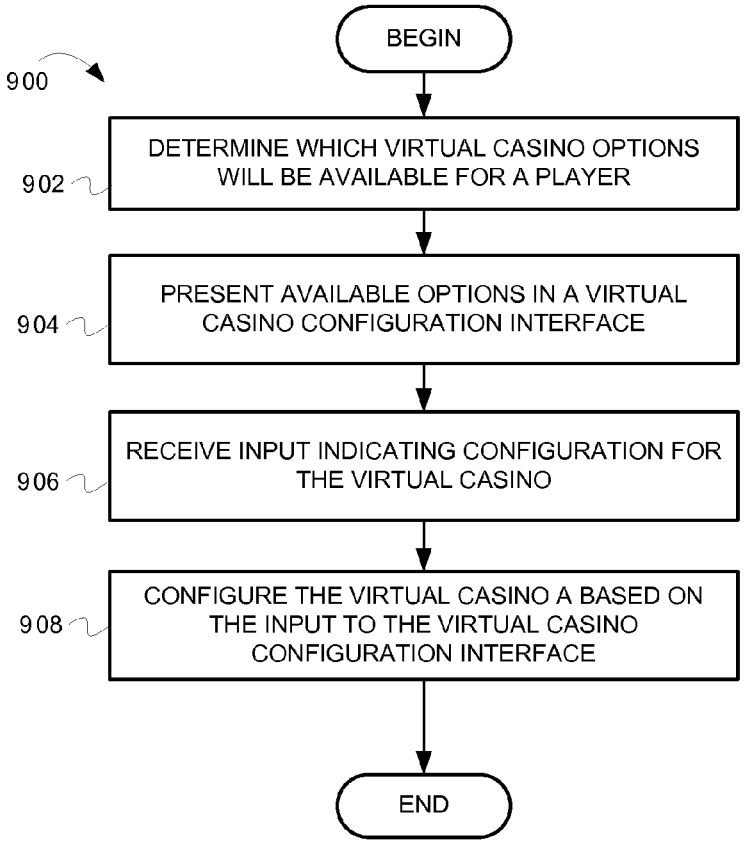
FIG. 9 is a flow diagram illustrating operations for enabling players to configure virtual casinos.
Figure 10:
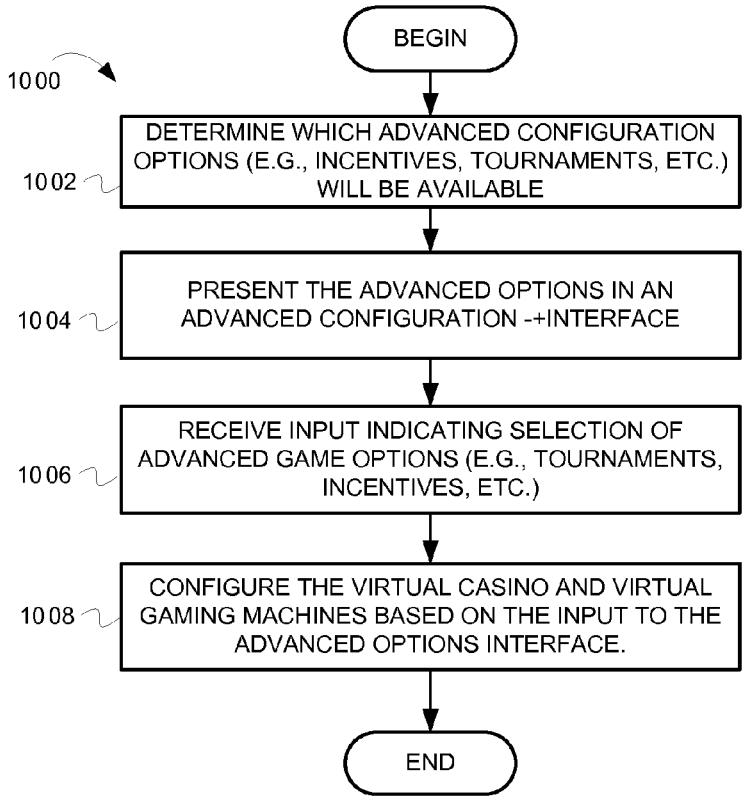
FIG. 10 is a flow diagram illustrating operations for advanced configuration of virtual casinos.

The online gaming server 519 can host a website on which players play wagering games. The online gaming server 519 can host any suitable online wagering games, such as video poker, video black jack, video roulette, video slots, etc. In some embodiments, the online gaming server 519 enables players to create their own virtual casinos at which other players can play wagering games. The operator of the online gaming server 519 may provide incentives to players who have popular casinos. For example, the operator may award virtual goods, points (redeemable for merchandise etc.), money, etc. to players with popular virtual casinos. The operator may require players to satisfy certain conditions before granting them access to various supplies for their virtual casino. For example, the operator may require players to play real-life versions of wagering games at breaks-and-mortar casinos before making the games available for the players' virtual casinos. As another example, the operator may reserve certain casino supplies (e.g., certain virtual wagering game machines) for those whose betting exceeds given thresholds. The discussion of FIGS. 8-10 provides more details about virtual casinos and online gaming servers.

The wagering game machines 502 described herein can take any suitable form, such as floor standing models, handheld mobile units, bartop models, workstation-type console models, etc. Further, the wagering game machines 502 can be primarily dedicated for use in conducting wagering games, or can include non-dedicated devices, such as mobile phones (see 503), personal digital assistants, personal computers, etc. In one embodiment, the wagering game network 500 can include other network devices, such as accounting servers, wide area progressive servers, player tracking servers, and/or other devices suitable for use in connection with embodiments of the invention.

In some embodiments, wagering game machines 502 and wagering game servers 506 work together such that a wagering game machine 502 can be operated as a thin, thick, or intermediate client. For example, one or more elements of game play may be controlled by the wagering game machine 502 (client) or the wagering game server 506 (server). Game play elements can include executable game code, lookup tables, configuration files, game outcome, audio or visual representations of the game, game assets or the like. In a thin-client example, the wagering game server 506 can perform functions such as determining game outcome or managing assets, while the wagering game machine 502 can present a graphical representation of such outcome or asset modification to the user (e.g., player). In a thick-client example, the wagering game machines 502 can determine game outcomes and communicate the outcomes to the wagering game server 506 for recording or managing a player's account.

In some embodiments, either the wagering game machines 502 (client) or the wagering game server 506 can provide functionality that is not directly related to game play. For example, account transactions and account rules may be managed centrally (e.g., by the wagering game server 506) or locally (e.g., by the wagering game machine 502). Other functionality not directly related to game play may include power management, presentation of advertising, software or firmware updates, system quality or security checks, etc.

Any of the wagering game network components (e.g., the wagering game machines 502) can include hardware and machine-readable media including instructions for performing the operations described herein.

Figure 11:
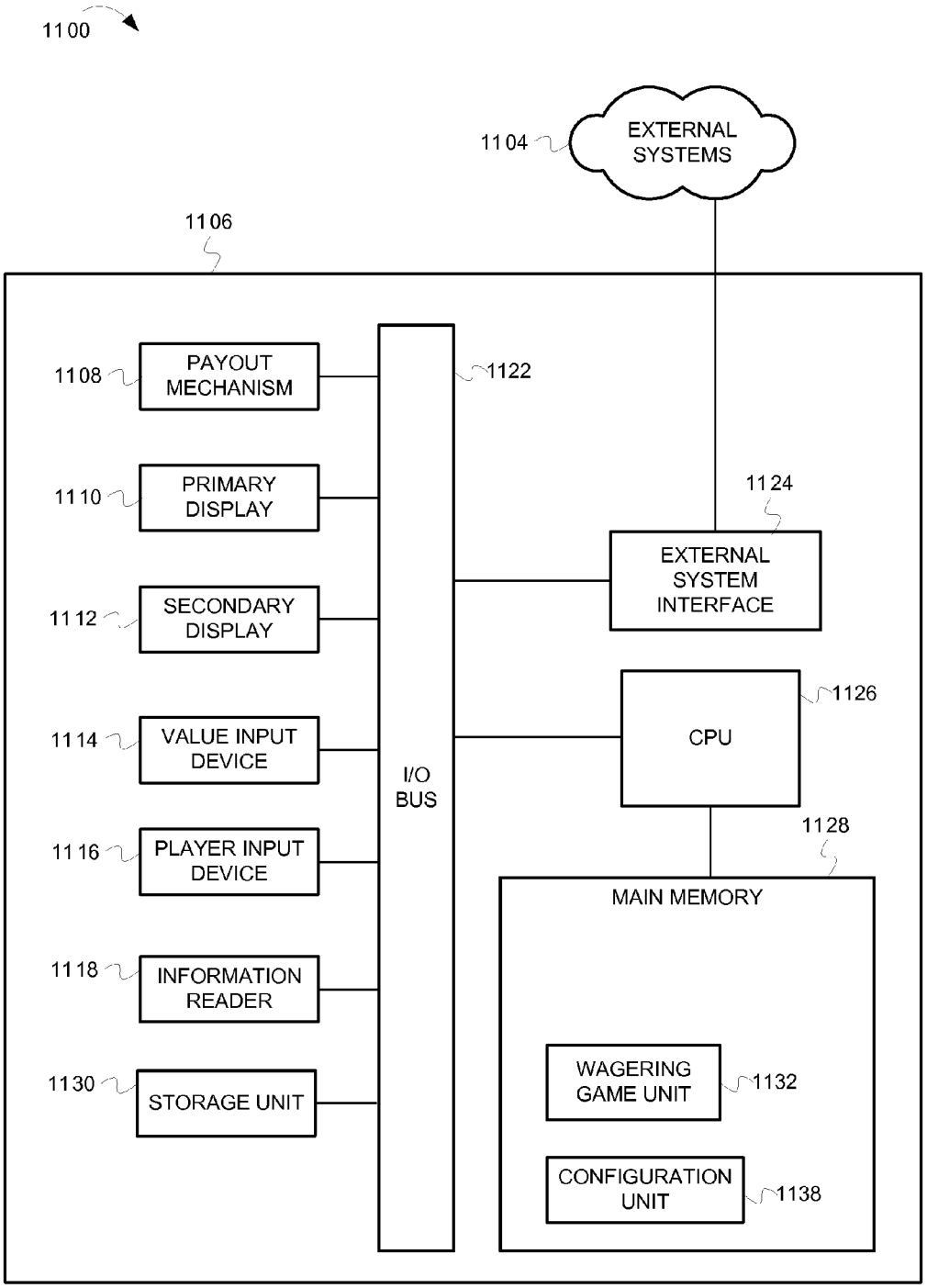
FIG. 11 is a block diagram illustrating a wagering game machine architecture, according to example embodiments of the invention.

While FIG. 11 describes an example wagering game machine architecture, this section continues with a discussion wagering game networks.

Operations

This section describes operations performed by some embodiments of the inventive subject matter. More specifically, the section will describe operations that enable players to configure and initiate multiplayer games, and operations that enable players to configure virtual casinos. In the discussion below, the flow diagrams will be described with reference to the block diagrams presented above. However, in some embodiments, the operations can be performed by logic not described in the block diagrams.

In certain embodiments, the operations can be performed by executing instructions residing on computer readable storage media (e.g., software), while in other embodiments, the operations can be performed by hardware and/or other components (e.g., firmware). In some embodiments, the operations can be performed in series, while in other embodiments, one or more of the operations can be performed in parallel. Moreover, some embodiments can perform less than all the operations shown in any flow diagram.

Operations for Wagering Game Selection GUI

Figure 6:
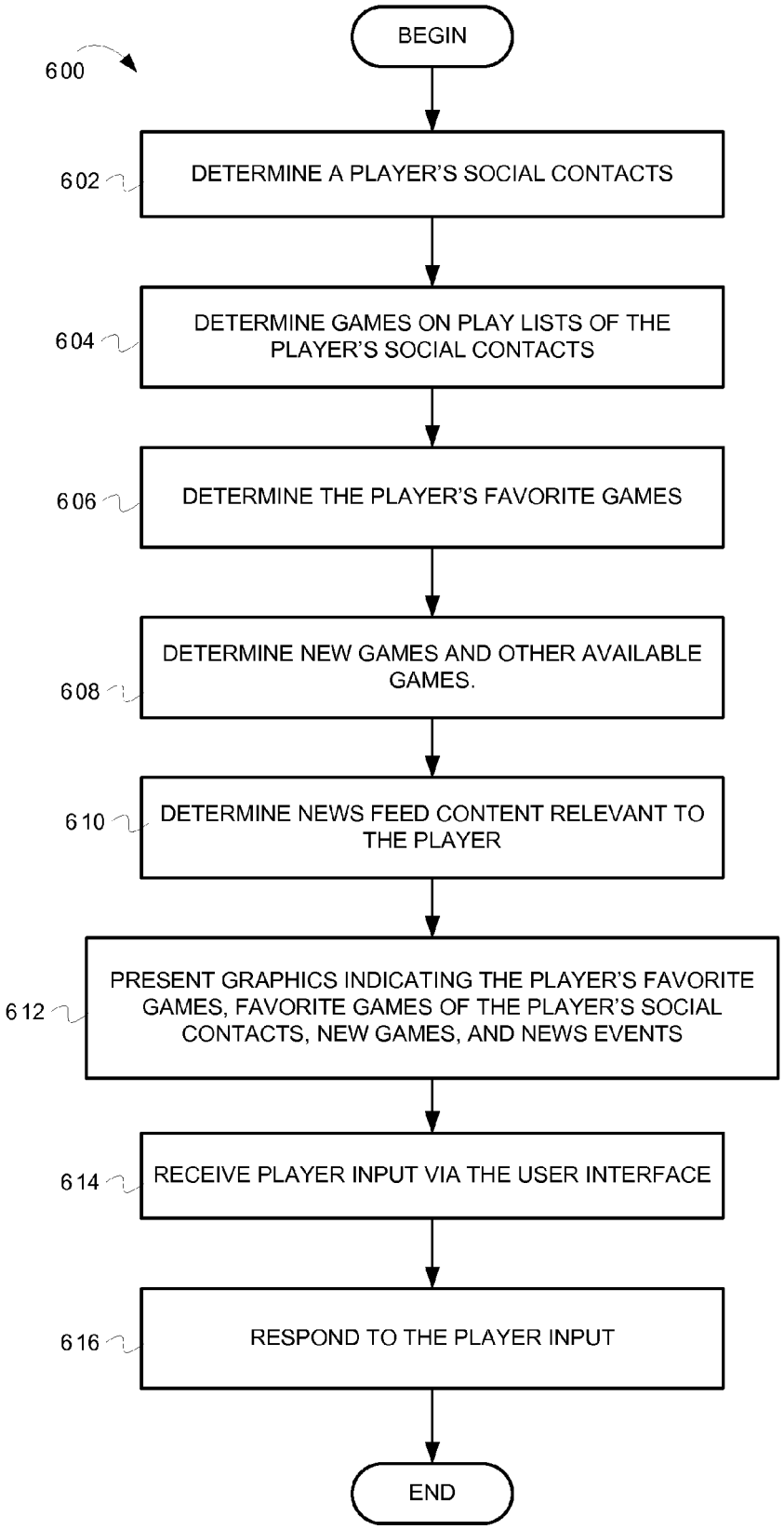
FIG. 6 is a flow diagram illustrating operations for presenting a graphical user interface through which players can select single-player and multiplayer wagering games.

FIG. 6 is a flow diagram illustrating operations for presenting a graphical user interface through which players can select single-player and multiplayer wagering games. In FIG. 6, a flow 600 begins at block 602, where a wagering game server determines a player's social contacts. In some embodiments, after a player logs-in the wagering game server via a wagering game machine 512, the wagering game server polls the virtual community server 520 and social networking server 512 to determine the player's social contacts. In some instances, the wagering game server can connect with Facebook via Facebook Connect. As noted above, some embodiments of the virtual community server and social networking server offer an application programming interface for sharing information. The flow continues at block 604.

At block 604, the wagering game server determines wagering games associated with the player's social contacts. For example, the wagering game server may have access to player tracking information (e.g., via a player tracking system hosted by the wagering game server itself or another device), where the player tracking information indicates games frequently played by the player's social contacts. In some embodiments, the social contacts can mark particular wagering games as "favorites", or otherwise show an affinity for certain wagering games. The wagering game server will present this information in a graphical user interface, as described below (see discussion of block 612). The flow continues at block 606.

At block 606, the wagering game server determines the player's favorite games. As similarly noted above, the wagering game server may store this information locally, or may access it from a remote player tracking system. The wagering game server will present this information in a graphical user interface, as described below (see discussion of block 612). The flow continues at block 607.

At block 608, the wagering game server determines a list of new games that are available for play. The wagering game server will present this information in a graphical user interface.

At block 610, the wagering game server determines news events relevant to the player. In some embodiments, news events indicate various events in the wagering game system, such as the player's social contacts logging into the system, playing games, winning awards, making interesting configuration choices, etc. Because the wagering game server controls all wagering game activities (game results, configuration changes, etc.), it can publish the news events relevant to the player. News events may be relevant if they describe events associated with the player or the player's social contacts. The flow continues at block 612.

At block 612, the wagering game server presents graphics indicating the player's favorite games, favorite game of the player's social contacts, new games, and news events. In some embodiments, the result of block 612 is the graphical user interface 200, shown in FIG. 2. The flow continues at block 614.

At block 614, the wagering game server receives input via the graphical user interface presented via the operation of block 612. For example, the server may receive input indicating that the player has selected a single-player game or a multiplayer game. At block 616, the wagering game server responds to the player input, such as by initiating a single-player or multiplayer game. From block 616, the flow ends.

In the discussion above, the wagering game server performs operations for presenting the graphical user interface. However, in some embodiments, an online gaming server can perform the flow 600, thereby presenting the GUI to online players. As a result, both online players and bricks-and-mortar casino players can utilize the GUI for selecting single-player and multiplayer wagering games, and for receiving news items.

As discussed vis-à-vis the graphical user interface shown in FIGS. 4 and 5, some embodiments enable players to configure and initiate multiplayer wagering games. This discussion will continue with a more detailed description of operations for conducting player-configured and player-initiated multiplayer wagering games.

Figure 7:
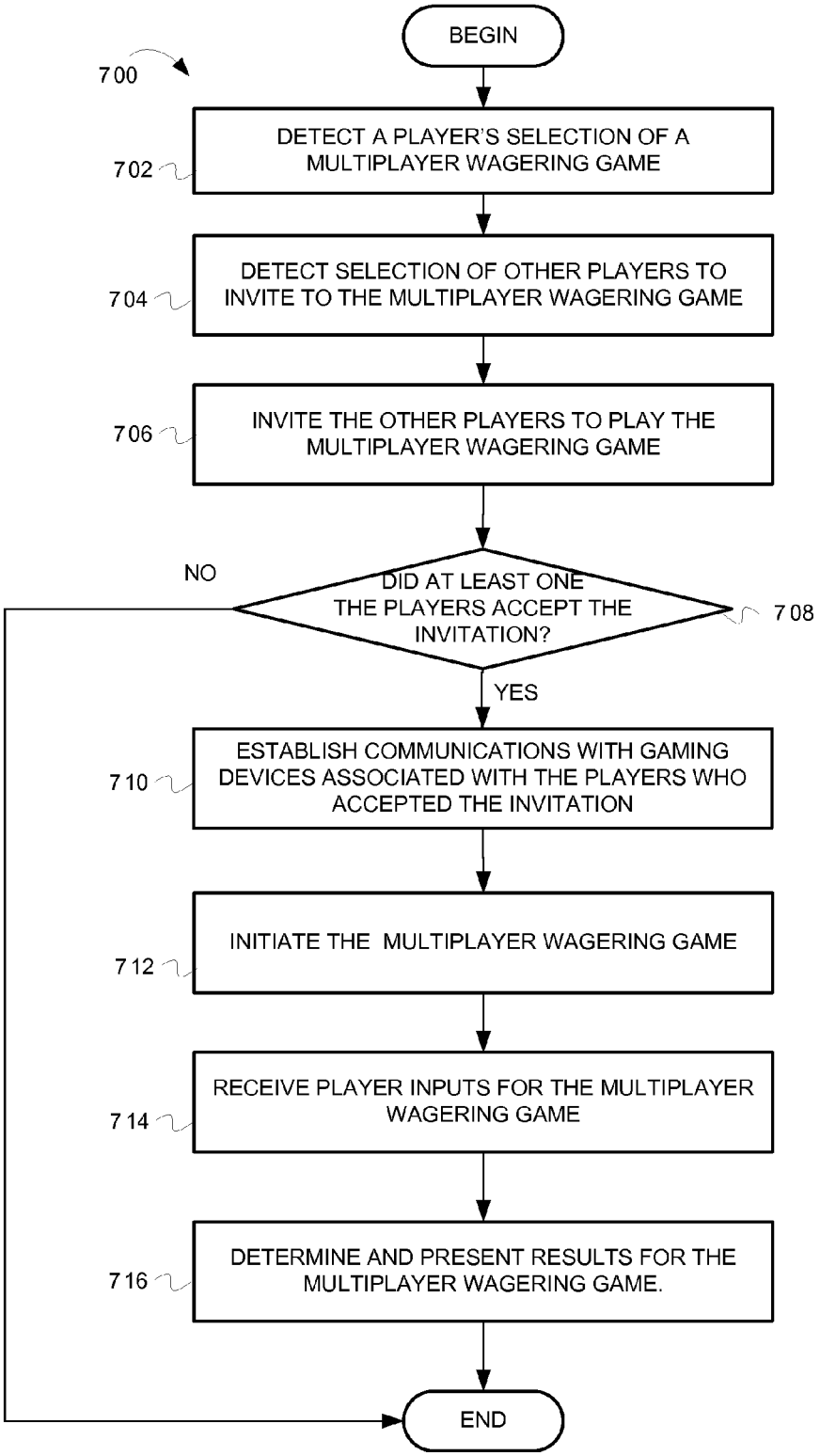
FIG. 7 is a flow diagram illustrating operations for conducting player-initiated and player-configured multiplayer wagering games.

FIG. 7 is a flow diagram illustrating operations for conducting player-initiated and player-configured multiplayer wagering games. In FIG. 7, a flow 700 begins at block 702, where a wagering game server detects a player's selection of a multiplayer wagering game. For example, referring to FIG. 2, the wagering game server may detect input indicating the player has selected a multiplayer game icon 212 (e.g., Monopoly Cashtopia). After selection of the multiplayer game icon 212, the icon 212 may expand, as shown in FIG. 2. The flow 700 continues at block 704.

At block 704, the wagering game server detects selection of other players to invite multiplayer wagering game. For example, refer to FIG. 2, the wagering game server may detect input indicating that the player dragged-and-dropped, onto the multiplayer game icon 212, icons associated with the player's friends. In FIG. 2, the friends' games icons 208 are associated with the player's friends (e.g., social contacts from one or more social networking websites). The flow continues at block 706.

At block 706, the wagering game server invites the selected players to play the multiplayer wagering game. The wagering game server can send instant messages or the like to players who are currently logged-in on the wagering game server. For players that are not currently logged in the wagering game server, the wagering game server can use other means for contacting the players, such as short messaging service (SMS) text messages, telephone calls, and messages, etc. the flow continues at block 708.

At block 708, the wagering game server determines whether one or more of the players accepted the invitation to play the multiplayer game. If none of the players accepted the invitation, the flow ends. Otherwise, the flow continues at block 710, where the wagering game server establishes communications with gaming devices associated with players who accepted invitations. For example, the wagering game server may establish communications with wagering game machines at bricks-and-mortar casinos and devices logged-in the online gaming server. As a result, some embodiments can conduct multiplayer games involving players at bricks-and-mortar casinos and players at the online casino. The flow continues at block 712.

At block 712, wagering game server initiates the multiplayer wagering game. As part of initiating multiplayer game, the wagering game server may determine initial game elements (e.g., playing cards), and communicate those elements to the players. Additionally, in some embodiments, wagering game server may provide content for representing the initial game elements. However, in other embodiments, content is stored remotely on the wagering game machines and other gaming device. The flow continues at block 714.

At block 714, wagering game server receives player inputs associated with the multiplayer wagering game. The player inputs can represent selection of game elements, wagers, and other input associated with playing the multiplayer game. At block 716, the wagering game server determines and presents results for the multiplayer wagering game. For some multiplayer games, the wagering game server loops through block 714 and 716 until the game is complete.

Operations for Virtual Casino Configuration

In addition to the configurability described above, some embodiments enable players to configure virtual casinos. Virtual casinos are computerized renditions of real-world casinos. Virtual casinos may have a multitude of virtual rooms (e.g., restaurants, lounges, etc.), virtual wagering game machines, and other various virtual objects (bars, tables, chairs, etc.). In the virtual casinos, players are represented by online personas known as avatars. Avatars can move about the virtual casinos, as they would similarly move about real-world casinos. For example, avatars may move about a virtual casino playing virtual wagering game machines. In some instances, avatars playing virtual wagering game machines correspond to real-life players who are playing online wagering games on the online gaming server. Embodiments of the inventive subject matter enable players to create and configure virtual casinos at which avatars play virtual wagering game machines. FIGS. 8-10 describe this in more detail.

FIG. 8 is a diagrammatic representation of a virtual casino, according to some embodiments of the inventive subject matter. As shown in FIG. 8, a virtual casino 800 can includes banks 802 of wagering game machines 811. In some instances, all virtual wagering game machines in a bank have the same configuration (e.g., theme, denominations, game type, etc.). For example, in FIG. 8, the virtual machines in each bank have the same theme and configuration. However, in other instances, banks may include virtual machines of different configurations.

In FIG. 8, avatars 810 are moving about the virtual casino 800. Some embodiments offer facilities by which avatars can interact with each other, such as chat, text, voice, etc. If an avatar is associated with a real-world online player, the avatar may move to a particular virtual wagering game machine and begin playing wagering games. In some embodiments, the virtual casino 800 may be "owned" by a real-world online player. That is, a real-world player may create and maintain a virtual casino using configuration tools offered on the online gaming server. In some embodiments, the player may purchase or otherwise earn virtual currency needed to acquire supplies for the virtual casino. In turn, the player may earn virtual currency for building casinos that attract frequent play by real-world players on the online gaming server. The discussion of FIGS. 9 and 10 provide more details about how players can configure virtual casinos. FIG. 9 describes configuring virtual casinos, whereas FIG. 10 describes setting-up tournaments, multiplayer games, incentives, etc. in the virtual casinos.

FIG. 9 is a flow diagram illustrating operations for enabling players to configure virtual casinos. In FIG. 9, a flow 900 begins at block 902, where the online gaming server determines which virtual casino options will be available for a player. Factors affecting availability of virtual casino options can include the player's coin-in (i.e., amount wagered), play frequency, social contacts, winnings, losses, etc. Casino configuration options may allow the player to:

- Add virtual wagering game machines to a virtual casino
- Configure one or more virtual wagering game machines with particular content, such as themes, game types, audio tracks, video tracks, special graphics, etc.

Configure pay mechanics (e.g., volatility, denominations, pay tables, etc.) of one or more wagering game machines Choose an architectural layout for the casino, where such layout can created by the player or chosen from templates based on real-life casinos Choose floor placement of virtual wagering game machines Choose the decor, lighting, ambient audio, etc.

Etc.

After determining virtual casino options, at block 904, the online gaming server presents the options in a virtual casino configuration GUI. The virtual casino configuration GUI can offer drag-and-drop tools for configuring the options available to the player. The flow continues at block 906.

At block 906, the online gaming server receives user input indicating selection of one or more options for configuring a virtual casino. For example, the online gaming server may receive selections of floor layouts, decor choices, etc. Additionally, the online gaming server may receive user input indicating selection of configuration options for a particular virtual wagering game machine (e.g., choosing denominations for virtual wagering game machine). As yet another example, the online gaming server may receive user input indicating that a player chooses to add more wagering game machines to a virtual casino. The flow continues at block 908.

At block 908, the online gaming server configures the player's virtual casino based on the input received at block 906.

After a player is configured a virtual casino, the player may want to offer tournaments, multiplayer games, and other incentives to attract players into the virtual casino. For example, a player may want to offer multiplayer wagering game tournaments to attract players into the virtual casino. Such a tournament may require a buy-in, and award the tournament winner all buy-in proceeds. Additionally, the virtual casino owner may provide a given amount of virtual currency to each tournament participant, thereby incentivizing participation. In some embodiments, sponsors or other entities (e.g., real-world casinos, wagering game manufacturers, the operator of the online gaming server, etc.) may reward virtual casino owners for posting popular and lucrative wagering game tournaments. Such awards may include virtual currency, monetary value, wagering game credits, virtual goods, etc. The following discussion refers to offering tournaments, multiplayer games, incentives, etc. as "advanced" configuration.

FIG. 10 is a flow diagram illustrating operations for advanced configuration of virtual casinos. FIG. 10 is similar to FIG. 9, but the flow in FIG. 10 includes "advanced configuration" options and an "advanced configuration interface." As noted above, the advanced configuration options can include tournament play, multiplayer games, and other options (e.g., incentives to attract players). In some embodiments, the advanced configuration interface can presents options for tournament-style play. The interface may also provide various tournament types, such as round robin, elimination tournaments, etc. Additionally, the advanced options may include different award schemes for the tournaments, such as winner-take-all, awards for top three, etc. The tournament-style play can work with all suitable wagering games types, including video slots, video poker, and video blackjack.

The advanced configuration interface can present options for defining conditions for establishing multiplayer games (e.g., when players achieve specific game events). Also, the advanced configuration interface may allow the virtual casino owner to give players control over multiplayer games, as described above.

In some embodiments, the online gaming server enables virtual casino owners to provide incentives to virtual casino players. The incentives may be in the form of virtual currency, virtual goods, money, gift certificates, merchandise, or any other suitable incentive. The advanced configuration interface may provide options that enable virtual casino owners to configure how players can earn incentives in the virtual casino. The online gaming server may provide accounting services that distribute incentives when specified conditions are met. For example, a virtual casino owner may purchase virtual currency, and set configuration options indicating conditions for distributing the virtual currency to players. The online gaming server can hold the virtual currency in an account. As players meet conditions for earning the virtual currency, the online gaming server can distribute virtual currency to player accounts. The online gaming server can perform similar operations for other incentive types, such as gift certificates, virtual goods, etc.

Example Wagering Game Machines

Wagering Game Machine Architectures

FIG. 11 is a block diagram illustrating a wagering game machine architecture, according to example embodiments of the invention. As shown in FIG. 11, the wagering game machine architecture 1100 includes a wagering game machine 1106, which includes a central processing unit (CPU) 1126 connected to main memory 1128. The CPU 1126 can include one or more processors, such as one or more Intel® Pentium processors, Intel® Core 2 Duo processors, AMD Opteron™ processors, or UltraSPARC processors. The main memory 1128 includes a wagering game unit 1132. In one embodiment, the wagering game unit 1132 can present wagering games, such as video poker, video black jack, video slots, video lottery, etc., in whole or part.

The CPU 1126 is also connected to an input/output (I/O) bus 1122, which can include any suitable bus technologies, such as an AGTL+ frontside bus and a PCI backside bus. The I/O bus 1122 is connected to a payout mechanism 1108, primary display 1110, secondary display 1112, value input device 1114, player input device 1116, information reader 1118, and storage unit 1130. The player input device 1116 can include the value input device 1114 to the extent the player input device 1116 is used to place wagers. The I/O bus 1122 is also connected to an external system interface 1124, which is connected to external systems 1104 (e.g., wagering game networks).

In one embodiment, the wagering game machine 1106 can include additional peripheral devices and/or more than one of each component shown in FIG. 11. For example, in one embodiment, the wagering game machine 1106 can include multiple external system interfaces 1124 and/or multiple CPUs 1126. In one embodiment, any of the components can be integrated or subdivided.

All embodiments described herein my include instructions stored on one or more computer readable mediums. The one or more computer readable mediums may include a computer readable signal medium or a computer readable storage medium. A computer readable storage medium may be an electronic, magnetic, optical, electromagnetic, infrared, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Figure 12:
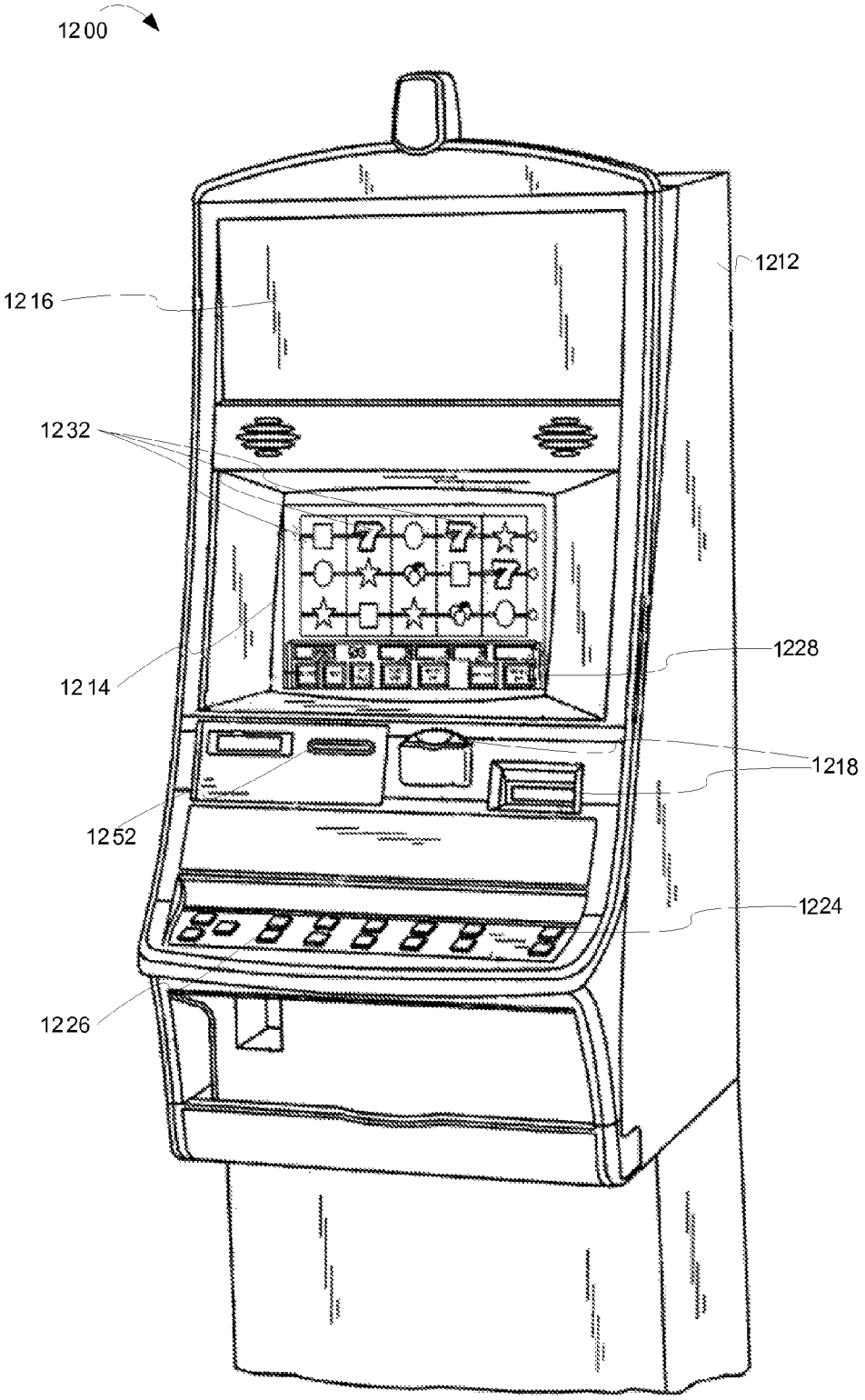
FIG. 12 is a perspective view of a wagering game machine, according to example embodiments of the invention.

FIG. 12 is a perspective view of a wagering game machine, according to example embodiments of the invention. Referring to FIG. 12, a wagering game machine 1200 is used in gaming establishments, such as casinos. According to embodiments, the wagering game machine 1200 can be any type of wagering game machine and can have varying structures and methods of operation. For example, the wagering game machine 1200 can be an electromechanical wagering game machine configured to play mechanical slots, or it can be an electronic wagering game machine configured to play video casino games, such as blackjack, slots, keno, poker, blackjack, roulette, etc.

The wagering game machine 1200 comprises a housing 1212 and includes input devices, including value input devices 1218 and a player input device 1224. For output, the wagering game machine 1200 includes a primary display 1214 for displaying information about a basic wagering game. The primary display 1214 can also display information about a bonus wagering game and a progressive wagering game. The wagering game machine 1200 also includes a secondary display 1216 for displaying wagering game events, wagering game outcomes, and/or signage information. While some components of the wagering game machine 1200 are described herein, numerous other elements can exist and can be used in any number or combination to create varying forms of the wagering game machine 1200.

The value input devices 1218 can take any suitable form and can be located on the front of the housing 1212. The value input devices 1218 can receive currency and/or credits inserted by a player. The value input devices 1218 can include coin acceptors for receiving coin currency and bill acceptors for receiving paper currency. Furthermore, the value input devices 1218 can include ticket readers or barcode scanners for reading information stored on vouchers, cards, or other tangible portable storage devices. The vouchers or cards can authorize access to central accounts, which can transfer money to the wagering game machine 1200.

The player input device 1224 comprises a plurality of push buttons on a button panel 1226 for operating the wagering game machine 1200. In addition, or alternatively, the player input device 1224 can comprise a touch screen 1228 mounted over the primary display 1214 and/or secondary display 1216.

The various components of the wagering game machine 1200 can be connected directly to, or contained within, the housing 1212. Alternatively, some of the wagering game machine's components can be located outside of the housing 1212, while being communicatively coupled with the wagering game machine 1200 using any suitable wired or wireless communication technology.

The operation of the basic wagering game can be displayed to the player on the primary display 1214. The primary display 1214 can also display a bonus game associated with the basic wagering game. The primary display 1214 can include a cathode ray tube (CRT), a high resolution liquid crystal display (LCD), a plasma display, light emitting diodes (LEDs), or any other type of display suitable for use in the wagering game machine 1200. Alternatively, the primary display 1214 can include a number of mechanical reels to display the outcome. In FIG. 12, the wagering game machine 1200 is an "upright" version in which the primary display 1214 is oriented vertically relative to the player. Alternatively, the wagering game machine can be a "slant-top" version in which the primary display 1214 is slanted at about a thirty-degree angle toward the player of the wagering game machine 1200. In yet another embodiment, the wagering game machine 1200 can exhibit any suitable form factor, such as a free standing model, bartop model, mobile handheld model, or workstation console model.

A player begins playing a basic wagering game by making a wager via the value input device 1218. The player can initiate play by using the player input device's buttons or touch screen 1228. The basic game can include arranging a plurality of symbols along a payline 1232, which indicates one or more outcomes of the basic game. Such outcomes can be randomly selected in response to player input. At least one of the outcomes, which can include any variation or combination of symbols, can trigger a bonus game.

In some embodiments, the wagering game machine 1200 can also include an information reader 1252, which can include a card reader, ticket reader, bar code scanner, RFID transceiver, or computer readable storage medium interface. In some embodiments, the information reader 1252 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A computer-implemented method for enabling a player to configure and initiate multiplayer wagering games, the method comprising:

detecting, via at least one of one or more electronic input devices of a wagering game machine, a physical item associated with a monetary value that establishes a credit balance, the wagering game machine including the one or more electronic input devices, an electronic display device, and one or more controllers;

presenting, on the electronic display device, a graphical user interface including social contact icons representing social contacts associated with the player, a multiplayer wagering game icon associated with a multiplayer wagering game, and a configuration interface for configuring the multiplayer wagering game;

determining configuration modifications input via the configuration interface, the configuration modifications altering at least one aspect of the multiplayer wagering game;

detecting input indicating selection of the multiplayer wagering game icon and one of the social contact icons, wherein the selected one of the social contact icons indicates a favorite game of a social contact represented by the selected one of the social contact icons;

transmitting, to the social contacts via a network, invitations to participate in the altered multiplayer wagering game, wherein the altered multiplayer wagering game includes content corresponding to the favorite game of the social contact;

detecting acceptance of the invitations from at least one of the social contacts;

initiating, in response to an input indicative of a wager covered by the credit balance, the altered multiplayer wagering game involving the player and the at least one of the social contacts;

determining a result of the altered multiplayer wagering game;

awarding, to at least one of the player and the at least one of the social contacts, an award based on the result of the altered multiplayer wagering game; and receiving, via at least one of the one or more electronic input devices, a cashout input that initiates a payout from the credit balance.

2. The computer-implemented method of claim 1 further comprising:

determining the social contacts associated with the player by accessing information from a remote social networking server.

3. The computer-implemented method of claim 1 further comprising:

determining the social contacts associated with the player by accessing information from an online community server that hosts online communities for wagering game players.

4. The computer-implemented method of claim 1 further comprising:

after detecting acceptance of the invitations, establishing communications with wagering game machines associated with those social contacts who accepted the invitations.

5. The computer-implemented method of claim 1 further comprising:

detecting wagering game events associated with the player and the social contacts;

creating news events indicating the wagering game events; and publishing, via the network, the news events for presentation in a newsfeed area of the graphical user interface.

6. A wagering game server configured to enable a player to initiate a group wagering game without needing to first achieve a wagering game result in a wagering game, the wagering game server comprising:

a processor; and a computer-readable memory including instructions for execution on the processor, the instructions for performing operations to, detect, via at least one of one or more electronic input devices of a wagering game machine, a physical item associated with a monetary value that establishes a credit balance, the wagering game machine including the one or more electronic input devices, an electronic display device, and one or more controllers, present group game icons, wherein each of the group game icons is associated with a wagering game designed for a group of players, present social contact icons that identify social contacts associated with the player, detect input indicating player selection of one of the social contact icons and one of the group game icons, wherein the selected one of the social contact icons indicates a favorite game of a social contact represented by the selected one of the social contact icons, notify social contacts about a group game, wherein the social contacts notified about the group game are associated with the selected one of the social contact icons, wherein the group game is associated with the one of the group game icons, and wherein the group game includes content corresponding to the favorite game of the social contact, initiate, in response to an input indicative of a wager covered by the credit balance, the group game, determine a result for the group game, provide, to at least one of the player and one of the social contacts, an award based on the result of the group game, present the result to the social contacts notified about the group game, and receive, via at least one of the one or more electronic input devices, a cashout input that initiates a payout from the credit balance.

7. The wagering game server of claim 6, wherein the social contacts associated with the player were established by an external social networking website, and wherein the operations further comprise operations to:

access, from the remote social networking website, contact information.

8. The wagering game server of claim 6, wherein the operations further comprise operations to:

determine the social contacts associated with the player by accessing information from an online community server that hosts online communities for wagering game players.

9. The wagering game server of claim 6, wherein the operations further comprise operations to:

establish communications with wagering game machines at which the social contacts associated with the player are logged-in.

10. The wagering game server of claim 6, wherein the operations further comprise operations to:

detect wagering game events associated with the player and the social contacts associated with the player;

create news events indicating the wagering game events; and publish, via the network, the news events to wagering game machines.

11. A non-transitory computer-readable memory device including instructions which, when executed by a wagering game machine, cause the wagering game machine to perform operations comprising:

detecting, via at least one of one or more electronic input devices of the wagering game machine, a physical item associated with a monetary value that establishes a credit balance, the wagering game machine including the one or more electronic input devices, an electronic display device, and one or more controllers;

presenting group game icons, wherein each of the group game icons is associated with a wagering game designed for a group of players;

presenting social contact icons that identify social contacts associated with a player;

detecting input indicating player selection of one of the social contact icons and one of the group game icons, wherein the selected one of the social contact icons indicates a favorite game of a social contact represented by the selected one of the social contact icons;

notifying social contacts about a group game, wherein the social contacts notified about the group game are associated with the selected one of the social contact icons, wherein the group game is associated with the one of the group game icons, and wherein the group game includes content corresponding to the favorite game of the social contact;

initiating, in response to an input indicative of a wager covered by the credit balance, the group game;

determining a result for the group game;

providing, to at least one of the player and one of the social contacts notified about the group game, an award based on the result of the group game;

presenting the result to the social contacts notified about the group game; and receiving, via at least one of the one or more electronic input devices, a cashout input that initiates a payout from the credit balance.

12. The non-transitory computer-readable memory device of claim 11, wherein the social contacts associated with the player were established by an external social networking website, and wherein the instructions further cause the wagering game machine to perform operations comprising:

accessing, from the remote social networking website, contact information.

13. The non-transitory computer-readable memory device of claim 11, wherein the instructions further cause the wagering game machine to perform operations comprising:

determining the social contacts associated with the player by accessing information from an online community server that hosts online communities for wagering game players.

14. The non-transitory computer-readable memory device of claim 11, wherein the instructions further cause the wagering game machine to perform operations comprising:

establishing communications with wagering game machines at which the social contacts associated with the player are logged-in.

15. The non-transitory computer-readable memory device of claim 11, wherein the instructions further cause the wagering game machine to perform operations comprising:

detect wagering game events associated with the player and the social contacts associated with the player;

create news events indicating the wagering game events; and publish, via the network, the news events to wagering game machines.

* * * * *